US009982396B2

(12) United States Patent
Lichtberger et al.

(10) Patent No.: US 9,982,396 B2
(45) Date of Patent: May 29, 2018

(54) APPARATUS FOR COMPACTING THE BALLAST BED OF A TRACK

(71) Applicant: HP3 Real GmbH, Vienna (AT)

(72) Inventors: Bernhard Lichtberger, Pregarten (AT); Hans Joerg Hofer, St. Marien (AT)

(73) Assignee: HP3 REAL GMBH, Vienna (AT)

( * ) Notice: Subject to any disclaimer, the term of this patent is extended or adjusted under 35 U.S.C. 154(b) by 330 days.

(21) Appl. No.: 14/597,547

(22) Filed: Jan. 15, 2015

(65) Prior Publication Data

US 2015/0211192 A1 Jul. 30, 2015

(30) Foreign Application Priority Data

Jan. 30, 2014 (EP) ..... 14153245

(51) Int. Cl.
*E01B 27/20* (2006.01)
*B06B 1/18* (2006.01)

(52) U.S. Cl.
CPC ..... *E01B 27/20* (2013.01); *B06B 1/183* (2013.01)

(58) Field of Classification Search
CPC ..... E01B 27/20
See application file for complete search history.

(56) References Cited

U.S. PATENT DOCUMENTS 3,159,233 A * 12/1964 Clynch ..... G01V 1/053 181/119
3,965,822 A * 6/1976 Stewart ..... E01B 27/13 104/12
4,046,078 A * 9/1977 Theurer ..... E01B 27/13 104/12
4,046,079 A * 9/1977 Theurer ..... E01B 27/13 104/12
4,068,595 A * 1/1978 Weber ..... B06B 1/18 104/12
4,092,903 A * 6/1978 Allmer ..... B06B 1/18 104/12
4,096,806 A * 6/1978 Allmer ..... B06B 1/18 104/10
4,248,154 A * 2/1981 Theurer ..... E01B 27/17 104/12
4,305,252 A 12/1981 Carlé et al.
(Continued)

FOREIGN PATENT DOCUMENTS

CH 641 064 A5 2/1984
EP 1 653 003 A2 5/2006

*Primary Examiner* — Zachary L Kuhfuss
(74) *Attorney, Agent, or Firm* — Muirhead and Saturnelli, LLC

(57) ABSTRACT

An apparatus is provided for compacting the ballast bed of a track, comprising a machine frame which is movable on the track with a stabiliser unit which runs on rollers on the track and is equipped with a vibration drive for producing a vibration in a plane parallel to the track. The stabiliser unit is preferably equipped with tension rollers engaging around the rail head. The stabiliser unit is linked in a height-adjustable manner to the machine frame with an adjusting drive and can be moved against the track under load. In order to provide advantageous constructional conditions it is provided that the vibration drive comprises at least one cylinder vibrator which is formed by a hydraulic cylinder and is triggered via a proportional or servo valve.

23 Claims, 3 Drawing Sheets

(56) References Cited

U.S. PATENT DOCUMENTS

| | | | | | |
|---|---|---|---|---|---|
| 4,388,981 | A * | 6/1983 | Fair | G01V 1/155 | 181/114 |
| 4,399,753 | A * | 8/1983 | Theurer | E01B 27/17 | 104/7.2 |
| 4,457,234 | A * | 7/1984 | Theurer | E01B 27/17 | 104/12 |
| 4,643,101 | A * | 2/1987 | Theurer | E01B 27/17 | 104/12 |
| 4,770,103 | A * | 9/1988 | Allmer | E01B 29/10 | 104/7.1 |
| 5,113,767 | A * | 5/1992 | Theurer | E01B 27/20 | 104/7.2 |
| 5,640,909 | A * | 6/1997 | Theurer | E01B 27/13 | 104/12 |
| 5,887,527 | A | 3/1999 | Theurer et al. | | |
| 2001/0027732 | A1* | 10/2001 | Theurer | E01B 35/04 | 104/12 |
| 2003/0135995 | A1* | 7/2003 | Glasson | F15B 15/283 | 29/832 |
| 2006/0090666 | A1 | 5/2006 | Theurer et al. | | |

* cited by examiner

APPARATUS FOR COMPACTING THE BALLAST BED OF A TRACK

TECHNICAL FIELD

This application relates to an apparatus for compacting the ballast bed of a track.

BACKGROUND OF THE INVENTION

Known stabiliser units, which are so-called dynamic track stabilisers, are currently vibration units which are equipped with a mechanical vibration drive comprising two eccentric masses rotating in opposite directions. The two rotating eccentric masses are coupled to each other via gearwheels in such a way that diametrically opposed rotation of the masses about the associated axes is ensured. The vibratory force components in the vertical direction cancel each other out with this arrangement and the vibratory force components are amplified in the horizontal direction, i.e. in a plane parallel to the track transversely to the longitudinal direction of the track. Heaps of rock such as railway ballast in particular can be compacted efficiently especially by action of horizontal vibrations, especially when the frequency is chosen in such a way that the ballast assumes an elastic-liquid behaviour, which is the case at frequencies greater than 30 Hertz. Dynamic track stabiliser units are used for compensating irregular initial settings of the track on the ballast bed by purposeful controlled anticipation in that they are removed right from the start. This substantially increases the lifespan of the geometric track position. It is also known in this context to install two eccentric vibration units together in a stabiliser unit which are arranged in succession in the longitudinal direction of the track, wherein both vibration units are then usually coupled via a crankshaft, so that they run in synchronicity with respect to frequency and phase. In order to prevent the stabiliser unit from freely slipping on the rail and thus optionally causing chatter marks or excessive wear and tear on the rails, it is necessary to support the units statically via hydraulic cylinders against the machine frame and to additionally provide clamping rollers in addition to the flanged wheels which keep the stabiliser unit in a virtually play-free manner on the track.

For the purpose of controlling the energy introduced into the substructure of the track, it is known to arrange the rotating eccentric masses in an adjustable manner, wherein a displacement of the eccentric mass to the outside with static frequency causes an increase in the dynamically acting forces. There are also measuring devices which indicate a deviation from a given target subsidence of the track in the longitudinal direction of the ballast bed. Similarly, measuring devices for measuring the transverse inclination in the height using inclinometers or physical pendulums for example are used. A continuous dynamic transverse displacement resistance measuring device is also known, which measuring device is based on the principle of measuring the hydraulic drive power of the mechanical vibration unit and equalisation with the friction loss of the track on the ballast. The friction loss can be calculated by measuring the load as a normal force and the frictional value of the sleeper on the ballast, which is also known as resistance to lateral displacement. The displacement resistance is thus not measured directly but indirectly. The resistance to lateral displacement is the relevant quantity critical to security for the safety against buckling of a continuously welded track. The resistance to lateral displacement is usually determined at 2 mm of displacement path. The typical vibration amplitudes of the track in the case of dynamic track stabilisers lie at approximately 2 to 3 mm. The resistance to lateral displacement is one of the important quantities critical to safety in the construction of tracks and is mostly determined by complex measurement of individual sleepers usually under undesirable track blocking.

The vertical stiffness of the track is determined by measuring the force which needs to be applied for a specific subsidence of the track. Measuring devices provided for this purpose are based on the principle of applying a static load, mostly using hydraulic cylinders which act on the railway wheel sets. The value of the force by subsidence then leads to a vertical stiffness, which is an important measure for evaluating the quality of the track and the behaviour of the track under repeatedly occurring train loads. Strongly fluctuating track stiffnesses lead to irregular cases of subsidence under train loads and thus to respective errors in the track geometry. Since the vertical stiffnesses are strongly non-linear, the statically measured vertical stiffness is only significant within limits.

Accordingly, it would be desirable to provide an apparatus of the kind mentioned above which has a simpler and more compact configuration and allows an especially effective stabilisation of a track on a ballast bed. The resistance to the lateral displacement and the vertical stiffness of a track shall be measured in the simplest possible way in accordance with a further development of the system described herein. Furthermore, introduction of resonant frequencies into a track shall be avoided and the time intervals for an introduction of the resonant frequency shall be kept as short as possible.

SUMMARY OF THE INVENTION

According to an embodiment of the system described herein, an apparatus for compacting the ballast bed of a track comprises a machine frame which is movable on the track with a stabiliser unit which runs on rollers on the track and is equipped with a vibration drive for producing a vibration in a plane parallel to the track, wherein the stabiliser unit is preferably equipped with tension rollers engaging around the rail head, and wherein the stabiliser unit is linked in a height-adjustable manner to the machine frame with an adjusting drive and can be moved against the track under load. The machine comprises flanged wheels and clamping rollers which can roll off on rails, wherein the flanged wheels are pressed by telescopic shafts against the rails in order to guide the stabiliser unit in a virtually play-free manner on the track. It is further provided that the vibration drive comprises at least one cylinder vibrator which is formed by a hydraulic cylinder and is triggered via a proportional or servo valve.

The measures in accordance with the system described herein lead to a configuration which is substantially simpler in comparison with the state of the art because at least only one vibration cylinder needs to be provided instead of two mounted eccentric shafts rotating in diametrically opposed directions. As a result, a gear and a cardan shaft drive for driving the eccentric shaft can be avoided. Furthermore, the complex eccentric adjustment for adjusting the impact force can be avoided, which is set in the cylinder vibrator simply by predetermining the respective amplitude. The system described herein allows avoiding the complex mechanical generation of vibrations by eccentric masses revolving in a diametrically opposed way and the complex adjustment of the vibratory force by hydraulic adjustment of said eccentric masses. The vibratory force is determined in the system described herein by the amplitude and the frequency of the especially compact cylinder vibrators and thus by the vibrating mass. For example, the hydraulic cylinder of the cylinder vibrator is supported on the stabiliser unit and the piston of the hydraulic cylinder forms and/or carries the vibrating mass(es). The open-loop or closed-loop control of the cylinder vibrator is carried out via a proportional valve or servo valve attached to the cylinder. The desired amplitude and frequency is predetermined by an open-loop or closed-loop control unit.

In order to enable carrying out open-loop or closed-loop control that is as precise as possible and to subsequently enable drawing conclusions in a simple manner on the resistance against lateral displacement, it is advantageous if the cylinder vibrator is equipped with a sensor measuring the piston position of the piston associated with the hydraulic cylinder. The question whether the sensor determines the position of a piston rod associated with the piston or a mass associated with the piston or the like is up to the person skilled in the art.

It is similarly recommended that a pressure sensor which measures the hydraulic pressure is assigned to the hydraulic cylinder of the cylinder vibrator for determining a static and dynamic resistance against lateral displacement of the track. The vibratory force can be amplified by auxiliary masses attached to the cylinder rods. For this purpose, the cylinder vibrator of the vibration drive, especially the hydraulic cylinder and/or its piston, is assigned at least one auxiliary mass for amplifying the dynamic force.

For the purpose of increasing the vibratory energy, the vibration drive can comprise two or even several coupled hydraulic cylinders with respectively integrated piston displacement measurement.

The types of vibration, for which the vibration drive and/or the adjusting drive can be excited, can preferably be freely predetermined by an open-loop or closed-loop control unit. In accordance with an advantageous embodiment of the system described herein, the vibration drive is formed by at least one synchronous cylinder, especially one with two piston rods. Such an apparatus can ensure that both rail tracks are loaded equally during the stabilisation or are provided with the same energy input.

It is additionally recommended if the stabiliser unit is linked in a height-adjustable manner to the machine frame via hydraulic adjusting cylinders which are preferably aligned vertically and can be moved against the track under load and can be excited vibromotively, wherein the adjusting cylinders also form a cylinder vibrator controlled by a proportional valve or servo valve. The adjusting cylinders are preferably equipped with at least one sensor each measuring the position of the piston and with pressure sensors measuring the hydraulic pressure preferably for determining a static and dynamic vertical stiffness of the track. All proportional and servo valves are preferably attached directly to the associated cylinders in order to keep potential pressure losses and vibrations in the feed lines as low as possible. The pressures in the vertical cylinders and in the horizontal cylinders are measured by pressure sensors.

The respective forces and subsequently the dynamic and static vertical stiffness can be determined via the measurement of the dynamic amplitudes of the adjusting cylinders and the hydraulic cylinder of the piston vibrator. The static force acts like a displacement of the operating point on the vertical stiffness line. The static and dynamic resistance against lateral displacement can be measured by measuring the horizontal force. Since the acting horizontal force on the cylinder is measured via the hydraulic pressure, the resistance against displacement can be determined directly. It is obvious that two vibration cylinders can also be switched in parallel. The amplitude and phase synchronicity of several cylinder vibrators or stabiliser units arranged successively in the longitudinal direction of the track is realised electronically via control loops. Simple measurement of the static and dynamic resistance against lateral displacement and the static and dynamic vertical stiffness can thus be realised by the system described herein.

An apparatus in accordance with the system described herein allows especially high control velocities of the system. In contrast, traditional eccentric systems with hydraulic eccentric adjustment show a considerable adjusting duration as a result of the high time constants. As a result of the direct generation of the vibratory frequency in accordance with the system described herein, the passing of resonant frequencies during start-up and shutdown of the stabiliser unit can be prevented or at least kept especially short. Since cylinder vibrators have a low overall size and overall height, they can be installed very close to the height of the upper edge of the rail, as a result of which a virtually pure horizontal force can be introduced into the track. The conventional systems known from the state of the art generally show a greater height due to the eccentric shafts arranged above each other, as a result of which vertical components are also introduced into the track as a result of the superimposed torques, which act in a considerably irregular manner on the track and lead to an undesirable side effect. As a result of the low overall height by using cylinder vibrators, the apparatus in accordance with the system described herein can easily be retrofitted even in existing track construction machines as well as ballast ploughs or the like. The rapid control time of the apparatus in accordance with the system described herein avoids trailing vibrations after the deactivation and running out of the eccentric shafts, which is especially unpleasant during work on bridges because the natural frequency band of the bridges is passed regularly.

The type of vibration can be chosen at will. It is possible to select sinusoidal, triangular, trapezoidal, rectangular or similar types of vibrations, as well as various fundamental vibrations with superimposed harmonics. A vertical vibration of the load cylinders not only leads to an improved controllability in the subsidence differences between the left and the right side of the track, but in any case to a higher compaction effect and improved subsidence, which further increases the lifespan of the geometric track position.

BRIEF DESCRIPTION OF THE DRAWINGS

Embodiments of the system described herein are schematically shown in the drawings, wherein.

DETAILED DESCRIPTION OF VARIOUS EMBODIMENTS

Figure 1:
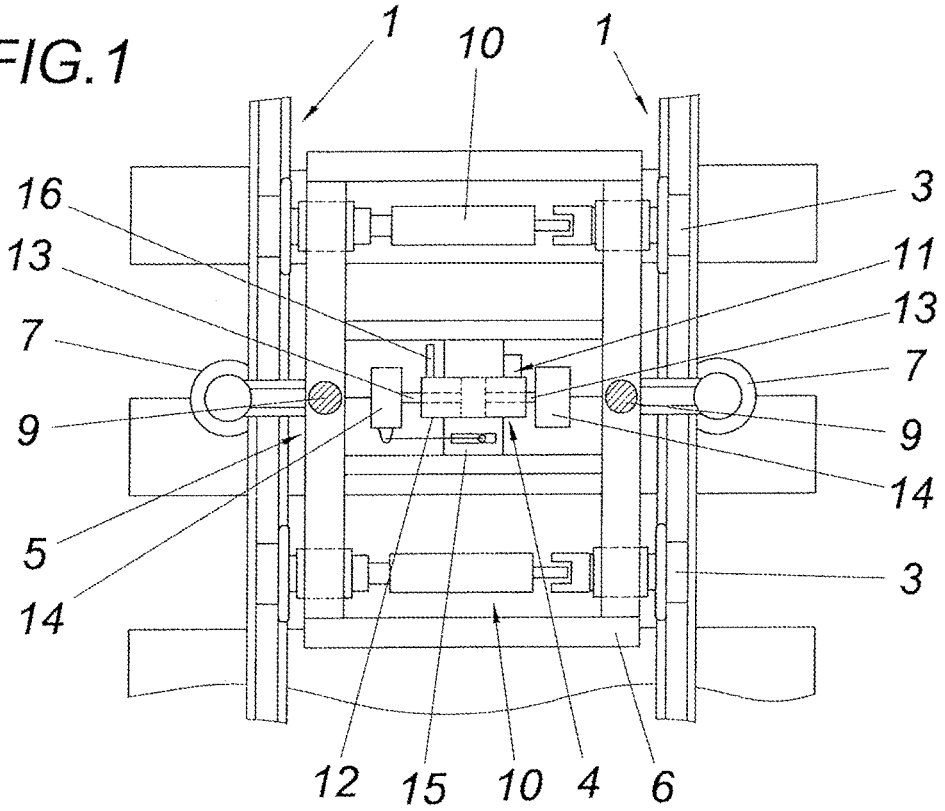
FIG. 1 shows a top view of a stabiliser unit in accordance with the system described herein.
Figure 2:
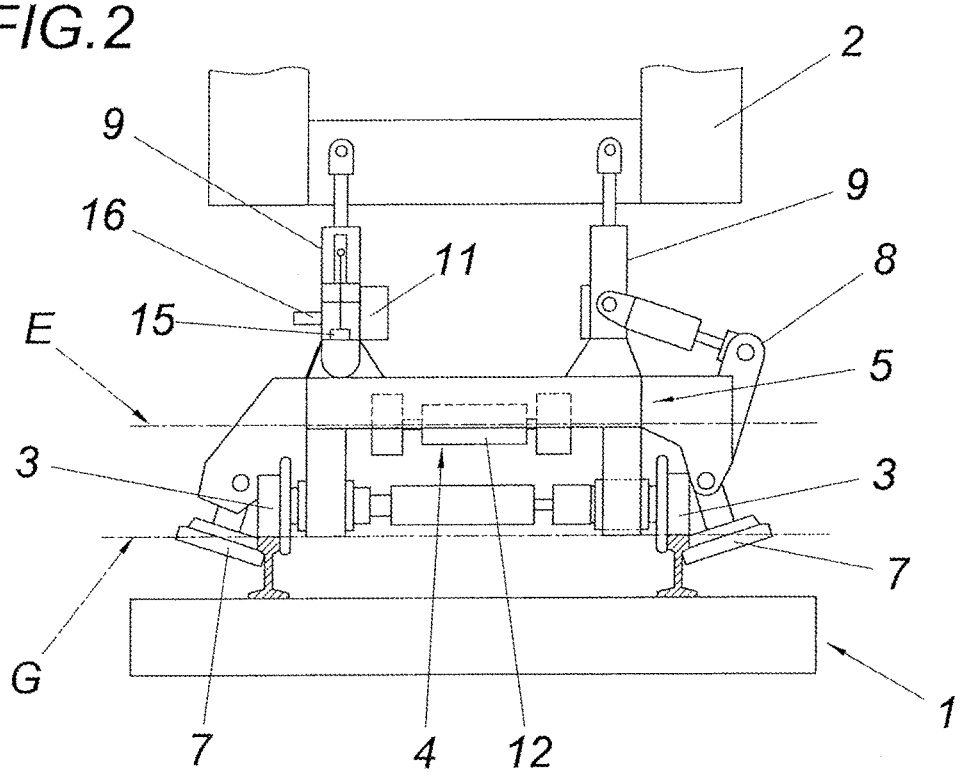
FIG. 2 shows a front view of the stabiliser unit of FIG. 1 in accordance with the system described herein.
Figure 3:
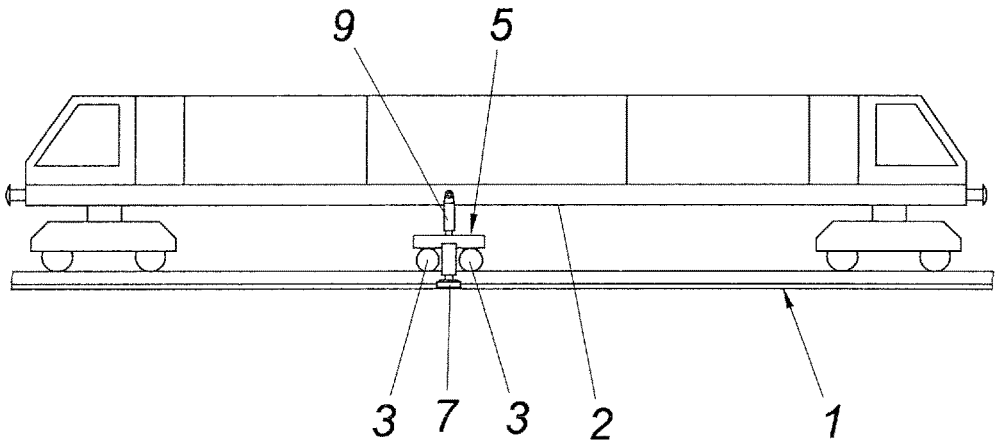
FIG. 3 shows a stabiliser unit of FIGS. 1 and 2 on a smaller scale which is arranged on a machine frame.

An apparatus for compacting the ballast bed of a track 1 comprises a machine frame 2, which is especially a part of a rail construction train or the like and which can be moved with a stabiliser unit 5 on the track 1, which stabiliser unit runs with rollers 3 on the track 1 and is provided with a vibration drive 4 for generating a vibration in a plane E which is parallel to the track, wherein the track plane is designated with reference G. The stabiliser unit 5 is attached to a frame 6, movable on the track 1 using rollers 3 equipped with wheels rims, and provided with tension rollers 7 which engage around the rail head and which are provided with a pivoting drive 8 for releasing the rail head in order to allow the stabiliser unit 5 to be released from the track 1 and to lift off from said track.

Furthermore, the stabiliser unit 5 is linked in a height-adjustable way to the machine frame 2 by an adjusting drive 9 (two hydraulic cylinders) and can be moved against the track 1 under load. The rollers 3 are equipped with telescopic shafts 10 which press the rollers 3 against the tracks, thus allowing variations in the track widths to be compensated and ensuring play-free guidance of the stabiliser unit 5 on the track transversely to the travelling direction.

In order to provide especially simple and compact overall conditions, the vibration drive 4 comprises at least one cylinder vibrator 12 which is triggered via a proportional or servo valve 11 and formed by a hydraulic cylinder. The cylinder vibrator 12 is formed by a synchronous cylinder with two piston rods 13, which respectively carry one auxiliary mass 14 each. The cylinder vibrator 12 is provided with a sensor 15 (displacement sensor) which measures the piston position of the hydraulic cylinder piston. The sensor 15 either measures the position of the piston directly, the piston rod or optionally the position of the auxiliary masses. Furthermore, the hydraulic cylinder of the cylinder vibrator 12 is associated with a pressure sensor 16 that measures the hydraulic pressure in order to subsequently enable the calculation of the static and dynamic lateral displacement resistance of the track 1.

The stabiliser unit 5 is linked in a height-adjustable way to the machine frame 2 via hydraulic adjusting cylinders forming the adjusting drive 9 and being vertically aligned, and can be moved under load against the track 1 and can be excited vibromotively. Such a force can thus be set via the adjusting cylinders with which the stabiliser unit 5 is pressed against the track 1 under support on the machine frame 2. The adjusting cylinders also form a cylinder vibrator which is controlled or regulated by a proportional or servo valve 11. The position of the adjusting cylinder piston is measured again by a sensor 15 and the adjusting cylinders are associated with a pressure sensor 16 measuring the hydraulic pressure for determining a static and dynamic vertical stiffness of the track.

Figure 4:
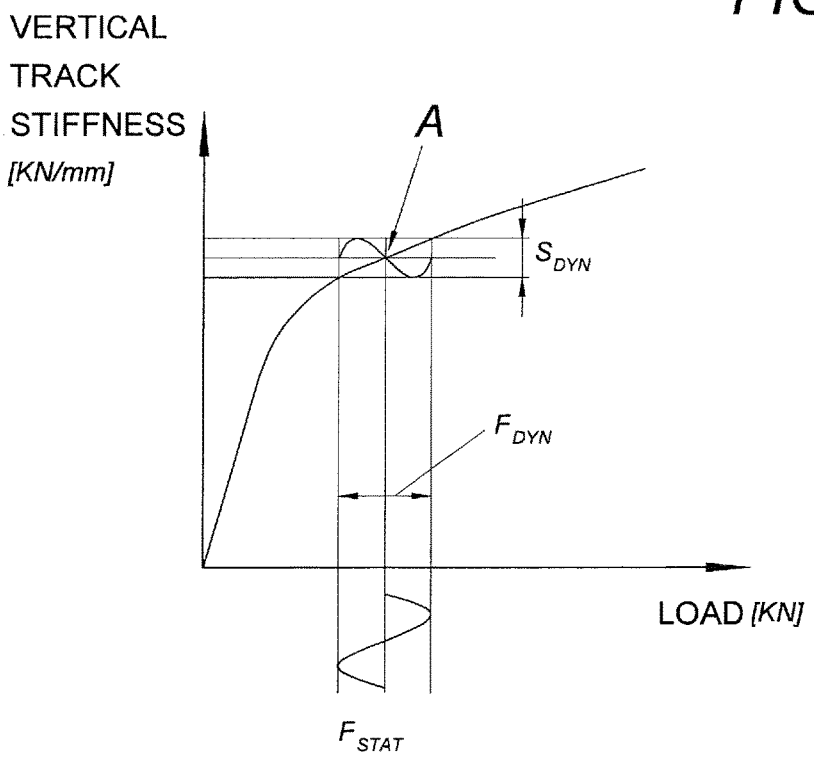
FIG. 4 shows a schematic diagram for vertical track stiffness over the load.

FIG. 4 shows a schematic diagram concerning the vertical stiffness of the track. It is composed of different individual stiffnesses such as rail elasticity, elasticity of the intermediate layer, the elasticity of the sleepers in the case of a potential elastic sleeper padding, the ballast, the stiffness of the track bed and/or the frost-protection layer, and the stiffness of the ground situated beneath. This characteristic curve is a highly non-linear one, as shown by the illustrated schematic curve. If a static force is applied by the vertical load, the track panel is lowered under said load. This subsidence is measured using the displacement sensors associated with the cylinders, i.e. the sensors 15. The force applied for this purpose can also be determined via the cylinder pressure measurement. Conclusions on the vertical stiffness stated in the diagram can be drawn from these data. The so-called operating point A is obtained from a specific static load $F_{STAT}$. Since the adjusting cylinders are also excited dynamically, a dynamic force fluctuation $F_{DYN}$ is obtained around this operating point, which corresponds to a vertical fluctuation in stiffness. The dynamic vertical stiffness $s_{DYN}$, which approximately corresponds to the tangent or ascent of the curve in the operating point, is obtained from a division of the stiffness fluctuation by the measure of the force fluctuation $F_{DYN}$.

Figure 5:
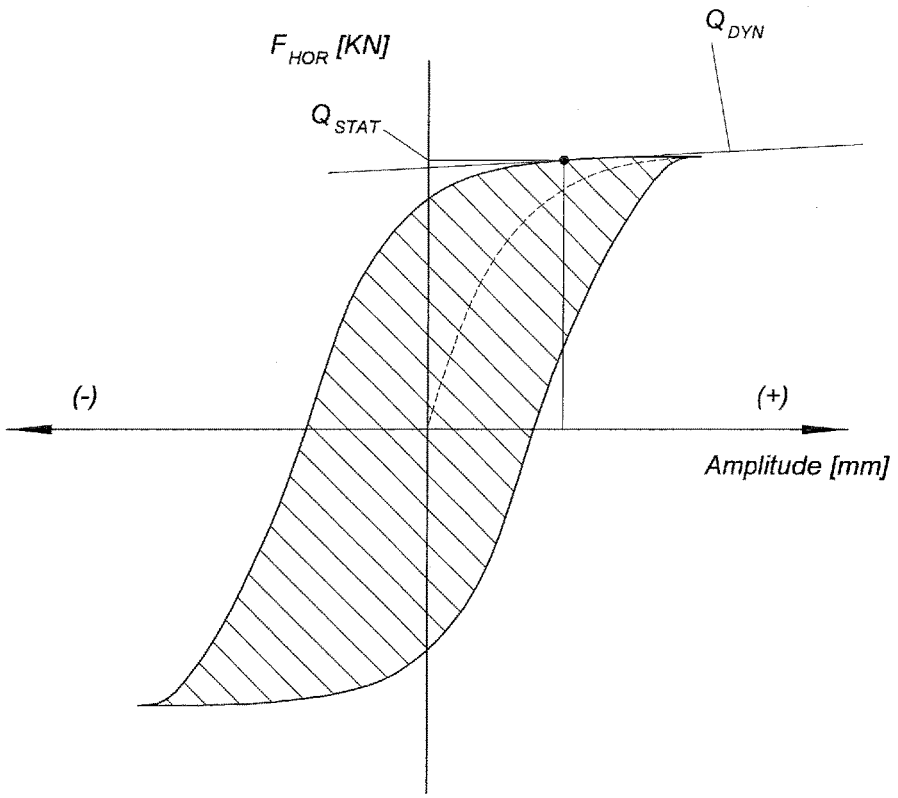
FIG. 5 shows a schematic diagram for the lateral displacement force over the amplitude.

FIG. 5 shows a schematic lateral displacement diagram of a track. The horizontal line shows the exciter amplitude of the vibration unit and the vibration path of the track in the ballast bed. The illustrated area beneath the curve corresponds to the actual frictional work done. The vertical line shows the horizontally acting force which needs to be applied for displacing the track panel. The displacement is measured by the displacement sensor attached to the cylinder vibrator and the force is determined via the hydraulic pressure measurement in the cylinder. It is common practice in the railway industry to determine the resistance against lateral displacement from a displacing force which is required for displacing the track by 2 mm from the zero position. Since the respective parameters of path and force are measured, it is possible to determine from the measured values the static resistance against lateral displacement at 2 mm and the ascent of the tangent in this operating point, i.e. the dynamic lateral displacement resistance.

Various embodiments discussed herein may be combined with each other in appropriate combinations in connection with the system described herein.

Additionally, in some instances, the order of steps in the described flow processing may be modified, where appropriate. Further, various aspects of the system described herein may be implemented using hardware, software, a combination of hardware and software and/or other computer-implemented modules or devices having the described features and performing the described functions. The system may further include a display and/or other computer components for providing a suitable interface with a user and/or with other computers.

Software implementations of aspects of the system described herein may include executable code that is stored in a computer-readable medium and executed by one or more processors. The computer-readable medium may include volatile memory and/or non-volatile memory, and may include, for example, a computer hard drive, ROM, RAM, flash memory, portable computer storage media such as a CD-ROM, a DVD-ROM, an SD card, a flash drive or other drive with, for example, a universal serial bus (USB) interface, and/or any other appropriate tangible or non-transitory computer-readable medium or computer memory on which executable code may be stored and executed by a processor. The system described herein may be used in connection with any appropriate operating system.

Other embodiments of the invention will be apparent to those skilled in the art from a consideration of the specification or practice of the invention disclosed herein. It is intended that the specification and examples be considered as exemplary only, with the true scope and spirit of the invention being indicated by the following claims.

The invention claimed is:

1. An apparatus for compacting the ballast bed of a track, comprising:

a machine frame which is movable on the track; and a stabiliser unit which runs on rollers on the track, wherein the stabiliser unit is linked in a height-adjustable manner to the machine frame with an adjusting drive and can be moved against the track under load, wherein the stabiliser unit includes a vibration drive for producing a vibration in a plane parallel to the track, and wherein the vibration drive comprises at least one cylinder vibrator which is formed by a hydraulic cylinder and is triggered via a proportional or servo valve and wherein the hydraulic cylinder of the cylinder vibrator is associated with a pressure cylinder measuring the hydraulic pressure for determining a static and dynamic resistance against lateral displacement of the track.

2. The apparatus according to claim 1, wherein the stabiliser unit is equipped with tension rollers engaging around a rail head.

3. The apparatus according to claim 1, wherein the stabiliser unit is linked in a height-adjustable manner to the machine frame via hydraulic adjusting cylinders which are aligned vertically, and can be moved under load against the track and can be excited in a vibromotive manner, and wherein the adjusting cylinders also form a cylinder vibrator which is controlled by a proportional or servo valve.

4. The apparatus according to claim 1, further comprising:

at least one auxiliary mass for amplifying the dynamic force, wherein the at least one auxiliary mass is associated with the cylinder vibrator of the vibration drive.

5. The apparatus according to claim 4, wherein the at least one auxiliary mass is associated with the hydraulic cylinder and/or a piston of the hydraulic cylinder.

6. The apparatus according to claim 1, wherein the vibration drive includes two mechanically coupled hydraulic cylinders, with each comprising integrated piston displacement measurement.

7. The apparatus according to claim 1, wherein types of vibration with which the vibration drive and/or the adjusting drive can be excited can be predetermined freely by an open-loop/closed-loop control unit.

8. The apparatus according to claim 1, wherein the at least one cylinder vibrator of the vibration drive is formed by a synchronous cylinder.

9. The apparatus according to claim 1, wherein the cylinder vibrator is equipped with a sensor which measures the piston position of the piston associated with the hydraulic cylinder.

10. An apparatus for compacting the ballast bed of a track, comprising:

a machine frame which is movable on the track; and a stabiliser unit which runs on rollers on the track, wherein the stabiliser unit is linked in a height-adjustable manner to the machine frame with an adjusting drive and can be moved against the track under load, wherein the stabiliser unit includes a vibration drive for producing a vibration in a plane parallel to the track, and wherein the vibration drive comprises at least one cylinder vibrator which is formed by a hydraulic cylinder and is triggered via a proportional or servo valve and wherein the cylinder vibrator is equipped with a sensor which measures the piston position of the piston associated with the hydraulic cylinder, wherein the at least one cylinder vibrator of the vibration drive is formed by a synchronous cylinder, wherein the stabiliser unit is linked in a height-adjustable manner to the machine frame via hydraulic adjusting cylinders which are aligned vertically, and can be moved under load against the track and can be excited in a vibromotive manner, and wherein the adjusting cylinders also form a cylinder vibrator which is controlled by a proportional or servo valve, wherein the adjusting cylinders are associated with pressure sensors measuring the hydraulic pressure for determining a static and dynamic vertical stiffness of the track.

11. The apparatus according to claim 10, wherein the adjusting cylinders are equipped with a sensor measuring a position of an associated piston.

12. An apparatus for compacting the ballast bed of a track, comprising:

a machine frame which is movable on the track; and a stabiliser unit which runs on rollers on the track, wherein the stabiliser unit is linked in a height-adjustable manner to the machine frame with an adjusting drive and can be moved against the track under load, wherein the stabiliser unit includes a vibration drive for producing a vibration in a plane parallel to the track, and wherein the vibration drive comprises at least one cylinder vibrator which is formed by a hydraulic cylinder and is triggered via a proportional or servo valve and wherein the at least one cylinder vibrator of the vibration drive is formed by a synchronous cylinder that comprises two piston rods.

13. The apparatus according to claim 12, wherein the cylinder vibrator is equipped with a sensor which measures the piston position of the piston associated with the hydraulic cylinder.

14. The apparatus according to claim 12, wherein the stabiliser unit is equipped with tension rollers engaging around a rail head.

15. The apparatus according to claim 12, wherein the stabiliser unit is linked in a height-adjustable manner to the machine frame via hydraulic adjusting cylinders which are aligned vertically, and can be moved under load against the track and can be excited in a vibromotive manner, and wherein the adjusting cylinders also form a cylinder vibrator which is controlled by a proportional or servo valve.

16. The apparatus according to claim 15, wherein the adjusting cylinders are equipped with a sensor measuring a position of an associated piston.

17. The apparatus according to claim 15, wherein the adjusting cylinders are associated with pressure sensors measuring the hydraulic pressure for determining a static and dynamic vertical stiffness of the track.

18. The apparatus according to claim 12, further comprising:

at least one auxiliary mass for amplifying the dynamic force, wherein the at least one auxiliary mass is associated with the cylinder vibrator of the vibration drive.

19. The apparatus according to claim 18, wherein the at least one auxiliary mass is associated with the hydraulic cylinder and/or a piston of the hydraulic cylinder.

20. The apparatus according to claim 12, wherein the vibration drive includes two mechanically coupled hydraulic cylinders, with each comprising integrated piston displacement measurement.

21. The apparatus according to claim 12, wherein types of vibration with which the vibration drive and/or the adjusting drive can be excited can be predetermined freely by an open-loop/closed-loop control unit.

22. An apparatus for compacting the ballast bed of a track, comprising:

a machine frame which is movable on the track; and a stabiliser unit which runs on rollers on the track, wherein the stabiliser unit is linked in a height-adjustable manner to the machine frame with an adjusting drive and can be moved against the track under load, wherein the stabiliser unit includes a vibration drive for producing a vibration in a plane parallel to the track, and wherein the vibration drive comprises at least one cylinder vibrator which is formed by a hydraulic cylinder and is triggered via a proportional or servo valve and wherein the cylinder vibrator is equipped with a sensor which measures the piston position of the piston associated with the hydraulic cylinder, wherein the hydraulic cylinder of the cylinder vibrator is associated with a pressure cylinder measuring the hydraulic pressure for determining a static and dynamic resistance against lateral displacement of the track.

23. An apparatus for compacting the ballast bed of a track, comprising:

a machine frame which is movable on the track; and a stabiliser unit which runs on rollers on the track, wherein the stabiliser unit is linked in a height-adjustable manner to the machine frame with an adjusting drive and can be moved against the track under load, wherein the stabiliser unit includes a vibration drive for producing a vibration in a plane parallel to the track, and wherein the vibration drive comprises at least one cylinder vibrator which is formed by a hydraulic cylinder and is triggered via a proportional or servo valve and wherein the cylinder vibrator is equipped with a sensor which measures the piston position of the piston associated with the hydraulic cylinder, wherein the at least one cylinder vibrator of the vibration drive is formed by a synchronous cylinder, wherein the synchronous cylinder comprises two piston rods.

* * * * *